US010646061B1

(12) United States Patent
Abbott

(10) Patent No.: US 10,646,061 B1
(45) Date of Patent: May 12, 2020

(54) RETENTION DEVICE FOR LOW-STRUCTURE FOOD ITEM AND METHOD OF OPERATION

(71) Applicant: Jordan Leroy Abbott, Medford, OR (US)

(72) Inventor: Jordan Leroy Abbott, Medford, OR (US)

( * ) Notice: Subject to any disclaimer, the term of this patent is extended or adjusted under 35 U.S.C. 154(b) by 0 days.

(21) Appl. No.: 16/445,454

(22) Filed: Jun. 19, 2019

Related U.S. Application Data

(60) Provisional application No. 62/834,608, filed on Apr. 16, 2019.

(51) Int. Cl.
*A47G 21/00* (2006.01)

(52) U.S. Cl.
CPC ..... *A47G 21/001* (2013.01)

(58) Field of Classification Search
CPC ..... A47G 21/001; A47G 21/023; A47J 43/18; A47J 43/283; B25J 15/0071; A22C 17/02; A23G 1/505; A23G 3/563
USPC ..... 294/5, 61
See application file for complete search history.

(56) References Cited

U.S. PATENT DOCUMENTS 941,798 A 7/1909 Moore
1,203,339 A 5/1915 Holstein
2,263,965 A 11/1939 Fiori
2,465,626 A * 3/1949 Barrett ..... A47G 21/10 294/5
2,585,089 A * 2/1952 Caldwell ..... B63B 21/08 24/559
3,010,500 A 11/1961 Jordan
3,975,043 A 8/1976 Miles
D258,634 S 3/1981 Adams
4,589,553 A * 5/1986 Ferrero ..... A47G 21/001 206/525
4,682,803 A 7/1987 Andrews
4,923,234 A 5/1990 Fairley
D312,757 S 12/1990 Zwang
5,649,728 A 7/1997 Warthen
D406,498 S 3/1999 Zirbes
D422,853 S 4/2000 Cheslow
6,494,517 B1 * 12/2002 Durant ..... A47G 21/10 294/33
D518,687 S * 4/2006 Baker ..... D24/143
7,165,270 B2 1/2007 DeYoung et al.
D575,460 S 8/2008 Patel
D765,461 S 9/2016 Palmer et al.
D804,237 S 12/2017 Takayama
9,883,760 B2 2/2018 Jeong
9,894,927 B1 2/2018 Roldan
(Continued)

*Primary Examiner* — Dean J Kramer
(74) *Attorney, Agent, or Firm* — Jerry Haynes Law

(57) ABSTRACT

A retention device for a low-structure food item and method of operation for holding a low-structure food, such as a bun-less sandwich, during preparation, holding, and consumption. The retention device comprises a pair of flat panels having spikes arranged on one side. The panels sandwich the food item above and below to provide a border that supports the food item while held and consumed. The panels have spikes on one side that orient towards the food item to penetrate the food item. The spikes maintain lateral stability of the food item during consumption. In operation, the panels press down on the food item from opposing sides, causing the spikes to penetrate the food item.

12 Claims, 5 Drawing Sheets

(56) References Cited

U.S. PATENT DOCUMENTS

| | | | |
|---|---|---|---|
| D830,097 | S | 10/2018 | Takayama |
| 2018/0332876 | A1 | 11/2018 | Roldan |

* cited by examiner

RETENTION DEVICE FOR LOW-STRUCTURE FOOD ITEM AND METHOD OF OPERATION

CROSS-REFERENCE TO RELATED APPLICATIONS

This application claims priority from U.S. Provisional Application Ser. No. 62/834,608, entitled "Retention Device for Low-Structure Food Item and Method of Operation", filed on Apr. 16, 2019, which application is hereby incorporated herein by reference in its entirety.

FIELD OF THE INVENTION

The present invention relates generally to a retention device to hold food items, more so, the present invention relates to a retention device that holds a low-structure food item and its method of operation.

BACKGROUND OF THE INVENTION

Those skilled in the art will recognize that you need a small amount of carbohydrate to fuel your body; the wrong carbohydrate can lead to weight gain. Cutting out refined carbohydrates is an easy way to reduce calories and improve your health. The pervasive popularity of eating healthy food or avoid unwanted carbohydrate such as bread and buns bun is almost essential today. Further some other people also do not prefer to eat breads at all. Some establishments let you order a low structure food item such as burger wrapped in lettuce leaves and of course you can always remove the bun and eat the inside with a fork or using fingers. Some examples of such low structure food items include bun less hot dogs, cheese dogs, Coney dogs, hamburgers, cheeseburgers, sandwiches or other food items including casseroles, gels, pates, and frozen liquids that is retained in such a manner. But using a fork, spoon or fingers to eat such types of food items is inconvenient to the user. Moreover, many establishments include a plastic knife, fork, bowl, lid, and extra "more than normal" napkins for each burger ordered thereby generating unwanted waste and harming the environment.

Numerous attempts have been made and several prior art devices are known for variety of holders for food products. Even though these innovations may be suitable for the specific purposes to which they address, however, they would not be as suitable for the purposes of the present invention.

For example, U.S. Pat. No. 941,798 to Moore discloses a corn sheller comprising two hinged sections adjustable to ears of corn of various sizes, said hinged sections having inwardly extending projections adapted to engage between the rows of corn and remove the grains of each row.

U.S. Pat. No. 1,203,339 to Holstein describes an improvement in ice-grip consisting of two grips having teeth adapted to be forced into the ice from opposite sides, thus affording handles to facilitate in moving and lifting the cake of ice.

U.S. Pat. No. 2,263,965 to Fiori teaches a fish holder for use by fishermen for holding a fish while removing the hook from its mouth. The fish holder comprises spring loaded prong type device having teeth at the inner sides of the prongs.

U.S. Pat. No. 3,010,500 to Jordan discloses a food holder and carving aid consisting of a skirt integral with a rigid body defined by a finger plate and a thumb plate, wherein a series of sharp rigid spurs integral with and projecting from the lower surface of said skirt so as to hold the food or meat with one hand to roast while leaving the other hand free to carve.

U.S. Pat. No. 3,975,043 to Miles describes a fish gripping device comprising a concave inner surface, and free outer edges while their inner edges are hingedly connected together by a hinge, further a spring connected to the hinge. The device may be held within a cupped hand of a user with the outer edges remote from the palm to grip objects like fish.

U.S. Pat. No. 4,682,803 to Andrews teaches a hand-held, fish gripping device comprises substantially identical rigid panels which are hingedly connected to one another to permit facile opening and secure closing, and which have friction-enhancing interior surfaces thereon.

U.S. Pat. No. 4,923,234 to Fairley discloses a cutlery implement in the form of food grasping tongs having juxtaposed clamping jaws with an adjustable separation for use with various different dimensioned food items. The clamping jaws are further provided with pointed projections for frictional engagement with food items.

U.S. Pat. No. 5,649,728 to Warthen describes a tong-like eating utensil having opposing prongs for use by a person in gripping pieces of food so that the person's hands do not come into direct contact with the food. Handles connected to rotating prong support brackets allow food secured by the prongs to be rotated into a variety of convenient positions for easy consumption.

U.S. Pat. No. 7,165,270 to DeYoung et al. teaches a food holder comprising a U-shaped body having a pair of opposite digit pockets for accepting fingers or a thumb of a user and a food pocket located between the digit pockets to hold food. The food holder is preferably used to hold food while the food is being cut.

U.S. Pat. No. 9,883,760 to Jeong discloses a disposable food grasping device having elongate individual portions corresponding to a middle finger, index finger and thumb respectively and arc-shaped bands securing the middle finger, index finger and thumb respectively, thereby to allow easy and accurate food pick-up without contacting the food on the fingers.

U.S. Pat. No. 9,894,927 and U.S. Patent application. No. 20180332876 to Roldan describe a method of forming a food holder out of vegetable products.

U.S. Design Pat. No. D258634 to Adams illustrates a combined food holder and carving aid.

U.S. Design Pat. No. D312757 to Zwang depicts a finger-gripping tool for eating food.

U.S. Design Pat. No. D406498 to Zirbes discloses a holding device for fruits and vegetables.

U.S. Design Pat. No. D422853 to Cheslow illustrates a food holding device.

U.S. Design Pat. No. D575460 to Patel depicts a mitt with asymmetrical pockets.

U.S. Design Pat. No. D765461 to Palmer et al. discloses a spiked food-holding bowl.

U.S. Design Pat. Nos. D830097 and D804237 to Takayama illustrate a cookware.

It is apparent now that numerous innovations that are adapted to an apparatus for holding food items, fish, ice cubes, or the like have been developed in the prior art that are adequate for various purposes. Furthermore, even though these innovations may be suitable for the specific purposes to which they address, accordingly, they would not be suitable for the purposes of the present invention as heretofore described. Thus a simple device and method for holding a low-structure food, such as a bun-less sandwich, and to restrict flowage of sauces, fats, and food juice during consumption is needed.

SUMMARY OF THE INVENTION

The present invention relates to an apparatus and method for holding a low-structure food, such as a bun-less sandwich, during consumption, through use of a pair of flat panels having multiple spaced-apart spikes arranged on one side, such that the panels provide a border that supports the low-structure food item, and the spikes penetrate the food item to maintain lateral stability while the food item is being held and consumed; and further a perimeter rim on the bottom panel to restrict flowage of sauces, fats, and food juice.

According to an aspect of the present invention, a retention device for low-structure food items, comprises a pair of flat, rigid panels defined by an edge, a food side, and an external side, the panels being operable to sandwich a low-structure food item from above and below; and a plurality of spikes disposed in a spaced-apart relationship from the food side of the panels, the spikes being defined by a sharp terminus, the spikes being operable to penetrate the low-structure food item, whereby the spikes help create lateral stability to the food item.

In view of the foregoing, it is therefore an objective of the present invention is to provide a retention device that provides a surface to hold low structure food item like a bun-less sandwich during consumption.

Another objective is to keep the hands clean while eating a low structure food item like a bun-less sandwich.

Another objective is to provide a device for carrying a low structure food item like a bun-less sandwich.

Another objective is to provide a device for preparing a low structure food item like a bun-less sandwich.

Yet another objective is to prevent condiments and food juice from seeping out the sides of the retention device through use of a rim.

Yet another objective is to provide a low cost, easy to manufacture and easy to use retention device for holding a low-structure food item, such as a bun-less sandwich, during consumption.

Yet another objective is to provide a device that would eliminate the need for plastic utensils or extra napkins thereby reducing waste and preserving natural resources.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
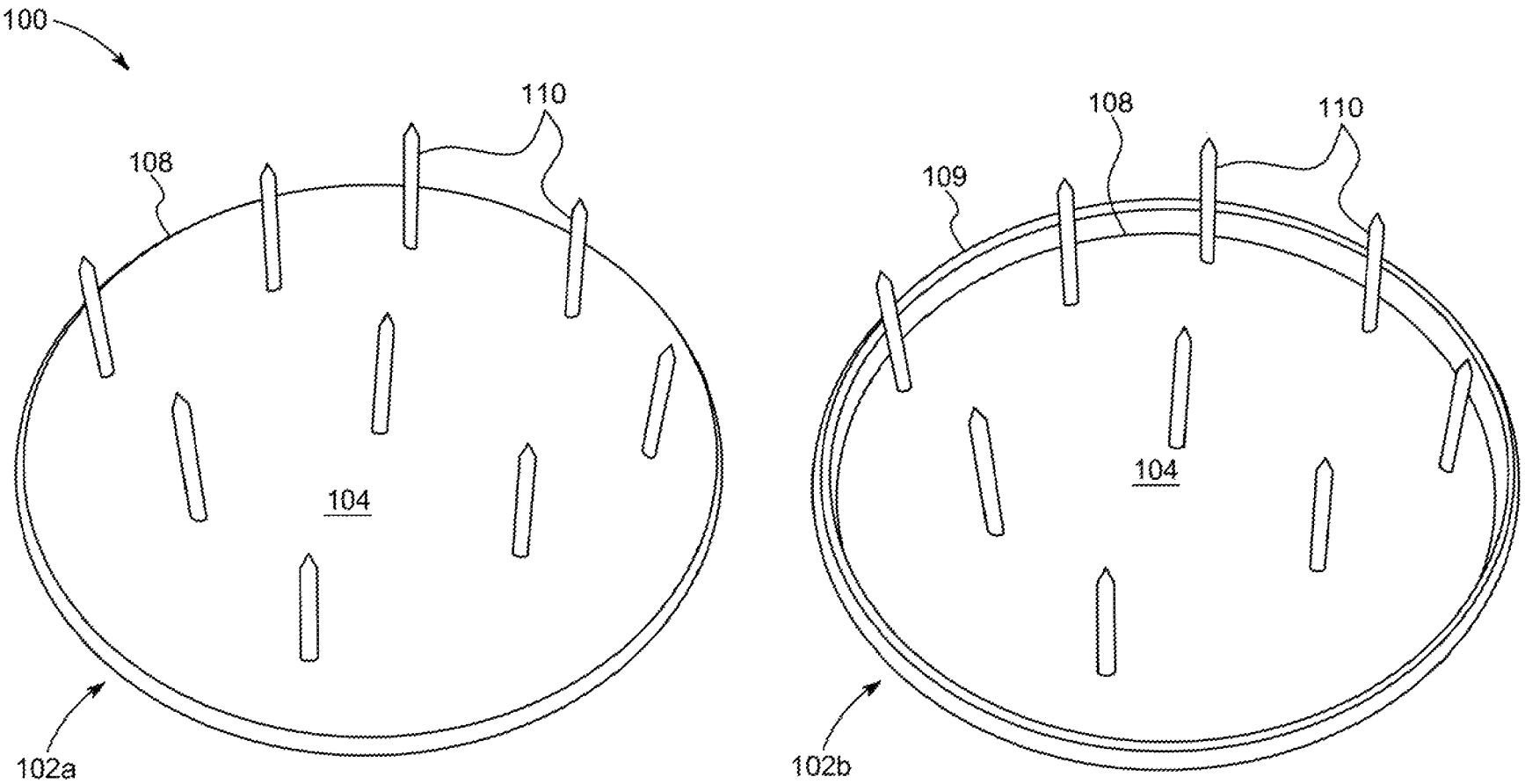
FIG. 1 illustrates a top perspective view of an exemplary top panel and a bottom panel for a retention device for low-structure food item, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A retention device 100 for low-structure food item 300 and method 700 of operation is referenced in FIGS. 1-7. The retention device is configured to hold a low-structure food, such as a bun-less sandwich, during preparation, holding, and consumption. A user can retain the food item 300 between the panels while consuming an outer region 400 of the food item. Thereafter, at least one of the panels 102*a*, 102*b* can be disengaged to enable the user to finish consuming a center region 500 of the food item 300.

As referenced in FIG. 1, the retention device 100 comprises a pair of flat panels 102*a*, 102*b* defined by an edge 108, a food side 104, and an external side 106. The panels 102*a*, 102*b* have multiple equidistant spaced-apart spikes 110 arranged on the food side 104 of each panel. The panels 102*a*, 102*b* are configured to sandwich the food item 300 from above and below; thereby creating a border around a center region of the food item 300 while the outer region 400 is being held and consumed. In one embodiment, the panels 102*a*, 102*b* have a diameter smaller than the food item 300, such that the outer region 400 of the food item 300 can be consumed while the panels 102*a*, 102*b* are engaged; and then after at least one of the panels are removed, the center region 500 is accessible for consumption.

The panels 102*a*, 102*b* have plurality of spikes 110 on the food side 104 of each panel that orient towards the low-structure food item 300 to penetrate the food item 300. The spikes 110 help to maintain lateral stability of the low-structure food item 300 while being held and consumed. In one alternative embodiment, a perimeter rim 109 forms at the bottom panel 102*b* to restrict flowage of viscous components, such as condiments, grease, and food juice, from falling off the edge 108 of the panels 102*a*, 102*b*, however both the panels 102*a*, 102*b* can have the perimeter rim 109 without departing from the scope and spirit of the present invention. In operation, the panels 102*a*, 102*b* press down on the food item 300 from opposing panel food sides, causing the spikes 110 to penetrate the food item 300. With the panels 102*a*, 102*b* engaged, the low-structure food item 300 is laterally stable, and can be consumed from an outer region 400. After the outer region 400 is consumed, the upper and/or bottom panel 102*a*, 102*b* is removed to provide access to, and finish consuming the center region 500 of the low-structure food item 300.

Figure 2:
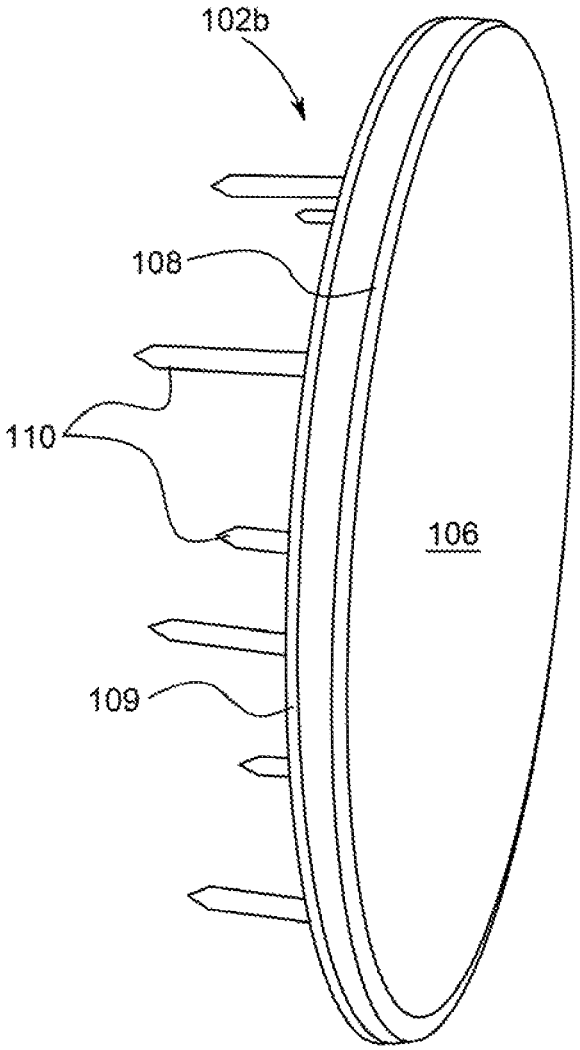
FIG. 2 illustrates a perspective view of an exemplary bottom panel for a retention device for low-structure food item, in accordance with an embodiment of the present invention.

One aspect of a retention device 100 for low-structure food items, shown in FIG. 2, comprises a pair of flat, rigid panels 102*a*, 102*b* defined by a food side 104 and an external side 106, the panels 102*a*, 102*b* being operable to sandwich a food item 300; and a plurality of rigid spikes 100 disposed in a spaced-apart relationship from the food side 104 of the panels 102*a*, 102*b*, the spikes 110 being defined by a sharp terminus penetrate the food item 300, whereby the spikes 110 help create lateral stability to the food item 300.

In another aspect, the panels 102*a*, 102*b* have an identical shape related to the shape of the low-structure food item 300 for example a round shape, a triangular shape, or any other desired shape that is suitable for holding the food item 300 at its center region 500. For holding and consuming a bun less burger the shape of the panels 102*a*, 102*b* may be circular; however for a bun less hotdog the shape of the panels 102*a*, 102*b* may be elongated. Shape of the panels 102*a*, 102*b* may be varied depending on the shape and structure of the food item without departing from the scope and spirit of the present invention.

In another aspect, the device 100 further comprises a rim 109 of predetermined height disposed at the perimeter 108 of the food side 104 of at least one of the panels 102*a*, 102*b*, thereby creating a border around a center region 500 of the food item 300 so as to facilitate to block viscous fluid of the food item 300 from spilling past the rim 109.

In another aspect, the low-structure food item 300 comprises a bun-less sandwich, comprising a stacked arrangement of meat, lettuce, cheese, and condiments.

In another aspect, the low-structure food item 300 comprises casseroles, gels, pates, and frozen liquids that is retained in such a manner.

In another aspect, the spikes 110 are manufactured from material selected from the group consisting stainless steel, metal alloys, a rigid polymer, and wood.

In another aspect, the panels 102*a*, 102*b* are manufactured from material selected from the group consisting stainless steel, metal alloys, a rigid polymer, and wood.

In another aspect, a retention device 100 for low-structure food items 300, the device 100 comprising a flat, rigid top panel 102*a* defined by a food side 104 and an external side 106, wherein one or more rigid spikes 110 are disposed in a spaced-apart relationship from the food side 104 of the top panel 102*a*; and a flat, rigid bottom panel 102*b* defined by a rim 109, a food side 104 and an external side 106, wherein a plurality of rigid spikes 110 are disposed in a spaced-apart relationship from the food side 104 of the bottom panel 102*b*, wherein the top panel 102*a* and the bottom panel 102*b* have a diameter smaller than the food item 300, thus allowing to sandwich the low-structure food item 300 in between the panels 102*a*, 102*b* and facilitate to hold the low-structure food item 300 at its center, whereby the spikes 110 being defined by a sharp terminus penetrate the low-structure food item 300 to provide lateral stability to the food item 300, further the rim 109 of the bottom panel 102*b* is raised to a predetermined height from the perimeter 108 of the flat surface of the food side 104 of the panel 102*b* thereby creating a border around a center region 500 of the food item 300 so as to facilitate to block viscous fluid of the food item 300 from spilling past the rim 109 of the bottom panel 102*b*.

In another aspect, a method 700 of holding low-structure food items 300 by a retention device 100, the method 700 comprising positioning center region 500 of a low-structure food item 300 on a flat, rigid bottom panel 102*b* of the retention device 100, the bottom panel 102*b* defined by a rim 109, a food side 104, and an external side 106, multiple rigid spikes 110 extending from the food side 104 of the bottom panel 102*b*; urging the food item 300 through the lower spikes 110; pressing a flat, rigid top panel 102*a* opposite to the bottom panel 102*b* of the device 100 while the food item 300 is sandwiched between the panels 102*a*, 102*b*, the top panel 102*a* defined by a food side 104, and an external side 106, multiple rigid spikes 110 extending from the food side 104 of the top panel 102*a*; urging the spikes 110 of the top panel 102*a* down until proximal or engaged with the bottom panel 102*b*, wherein the panels 102*a*, 102*b* have a diameter smaller than the food item 300, thereby exposing an outer region 400 of the food item 300 outside the panels 102*a*, 102*b*; consuming the outer region 400 of the food item 300; restricting viscous components of the food item 300 from falling off the edge of the panels 102*a*, 102*b* with the rim 109 of the bottom panel 102*b*, wherein the rim 109 of the bottom panel 102*b* is raised to a predetermined height thereby creating a border around the center region 500 of the food item 300; disengaging at least one of the panels 102*a*, 102*b* from the food item 300; and consuming the center region 500 of the food item 300.

In another aspect, the method allows the retention device to hold the low-structure food item during preparation, holding, and consumption.

Looking again at FIG. 1, a retention device 100 for low-structure food items comprises a pair of flat, rigid panels 102*a*, 102*b* that are defined by a food side 104 and an external side 106. In one non-limiting embodiment, the panels 102*a*, 102*b* are defined by a circular shape. In other embodiments, the panels 102*a*, 102*b* may have a square shape, a triangular shape, and an irregular shape or the panels 102*a*, 102*b* may have an identical shape related to the shape of the low-structure food item 300. Suitable materials for the panels 102*a*, 102*b* may include, without limitation, stainless steel, metal alloys, a rigid polymer, and wood.

Figure 3:
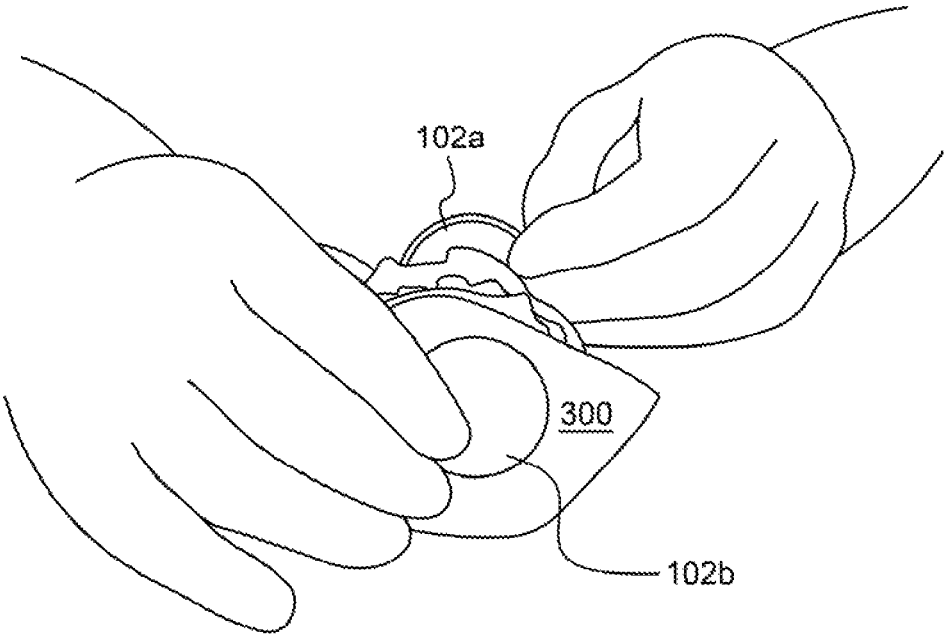
FIG. 3 illustrates a perspective view of an exemplary low-structure food item being positioned between the top panel and the bottom panel, with the spikes penetrating the food item, in accordance with an embodiment of the present invention.
Figure 4:
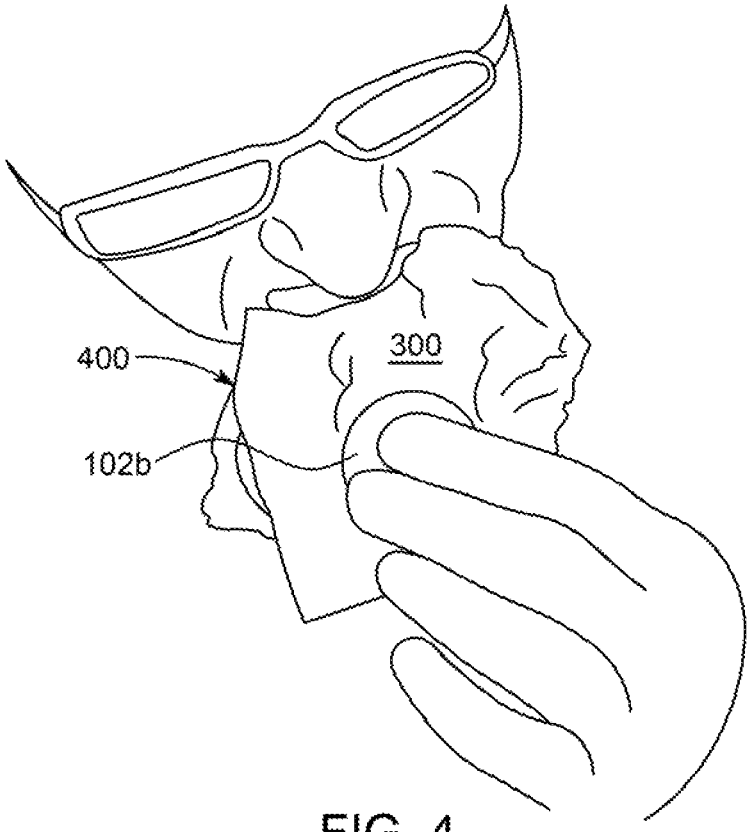
FIG. 4 illustrates a perspective view of an outer region of the food item being consumed while held between the panels, in accordance with an embodiment of the present invention.
Figure 5:
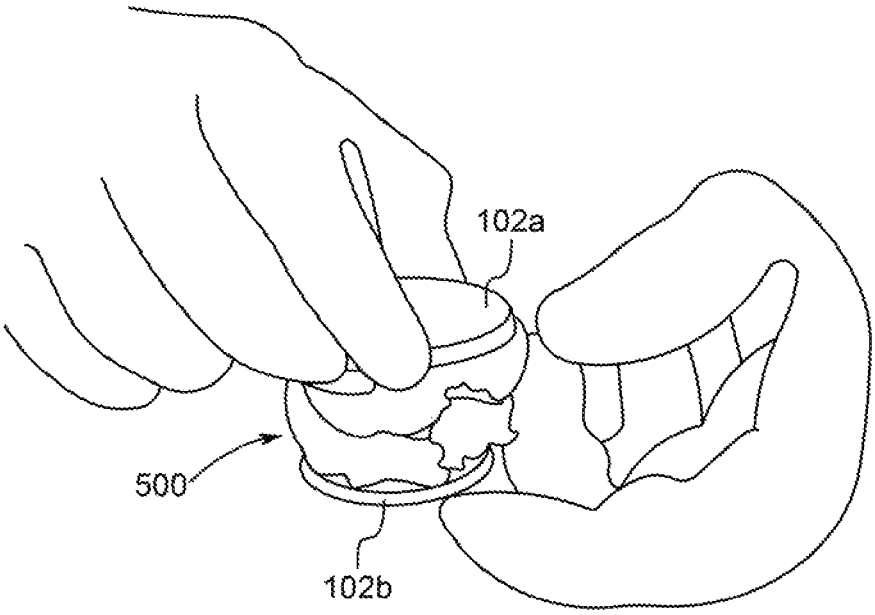
FIG. 5 illustrates a perspective view of the top panel being removed to access the center region of the food item, with the spikes penetrating the food item, in accordance with an embodiment of the present invention.

As shown in FIG. 3, the panels 102*a*, 102*b* are operable to sandwich a low structure food-item 300 from above and below by pressing down the panels 102*a*, 102*b* on both sides of the food item 300. The panels 102*a*, 102*b* are sized to enable consumption of a substantial amount 400 of the food item 300 while the panels 102*a*, 102*b* are engaged. In one embodiment, the panels 102*a*, 102*b* have a diameter smaller than the food item 300, such that the edges 400 of the food item 300 can be consumed while the panels 102*a*, 102*b* are engaged (FIG. 4). After the outer region 400 of the food item 300 is consumed, the panels 102*a*, 102*b* may be removed to enable consumption of the center region 500 of the food item 300 (FIG. 5).

In some embodiments, the low-structure food item 300 may include a bun-less sandwich made of a stacked arrangement of meat, lettuce, cheese, and condiments. Though in other embodiments, other low-structure food items, such as casseroles, gels, pates, and frozen liquids may be retained in such a manner. However the retention device can be used to hold other items without departing from the scope and spirit of the present invention.

The device 100 also provides a plurality of spikes 110 that are disposed in a spaced-apart relationship on the food side 104 of the panels 102*a*, 102*b*. The spikes 110 are defined by a sharp terminus that is sufficiently sharp to penetrate the food item 300. The spikes are sufficiently rigid, so as not to bend when penetrating the food item 300. The spikes 110 are configured to penetrate the low-structure food item 300. Thus, the spikes 110 create lateral stability to the food item 300, preventing the components of the food item 300 from sliding to the edges of the panels 102*a*, 102*b*. Suitable materials for the spikes 110 may include, without limitation, stainless steel, metal alloys, a rigid polymer, and wood.

In alternative embodiments, one of the panels 102*a*, 102*b*, including the bottom panel 102*b*, provides a perimeter rim 109. The perimeter rim 109 is disposed at the perimeter 108 of the food side 104 of the panel 102*b*. The perimeter rim 109 raises a few millimeters above the bottom panel 102*b*, working to block the viscous components of the food item 300 from spilling past the perimeter 108. The perimeter rim 109 creates a cleaner holding and consumption experience for the user.

Figure 6:
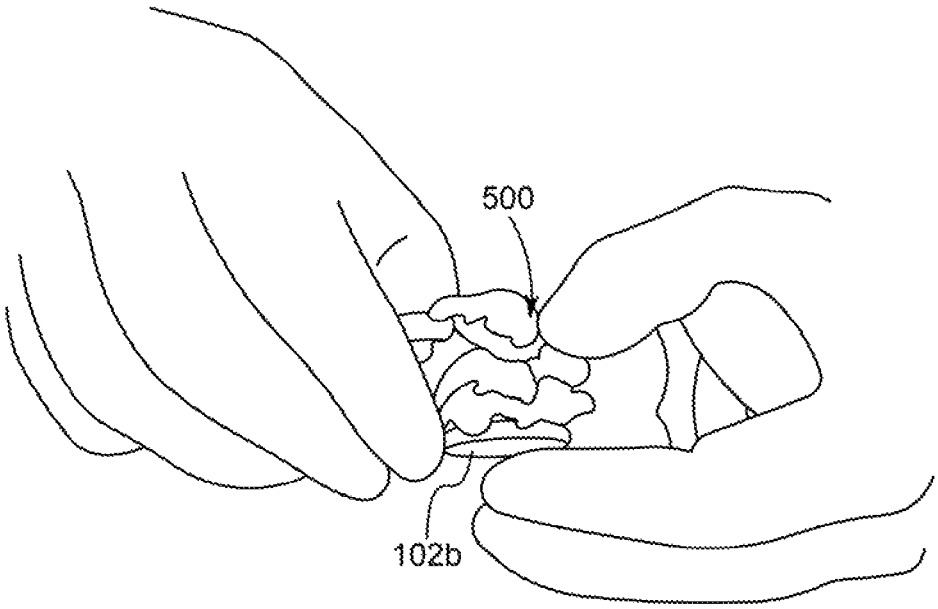
FIG. 6 illustrates a perspective view of a center region of the food item being consumed with the top panel removed, in accordance with an embodiment of the present invention.

In operation, the low-structure food item 300 is placed on a bottom panel 102*b*. The food item 300 is pressed against spikes 110 in the bottom panel 102*b*. A top panel 102*a* presses down on the food item 300 from opposite side of the bottom panel 102*b*. The spikes 110 of the upper panel 102*a* penetrate the food item 300 until the terminus of each spikes 110 is proximal, or engages the opposing panel. The low-structure food item 300 can be consumed from the outer region 400 while both panels 102*a*, 102*b* are engaged in this sandwich arrangement. Then, the upper panel 102*a* and/or the bottom panel 102*b* disengaged to provide access to, and finish consuming the center region 500 of the low-structure food item 300. FIG. 6 illustrates a perspective view of the center region 500 of the food item being consumed with the top panel 102*a* removed.

Figure 7:
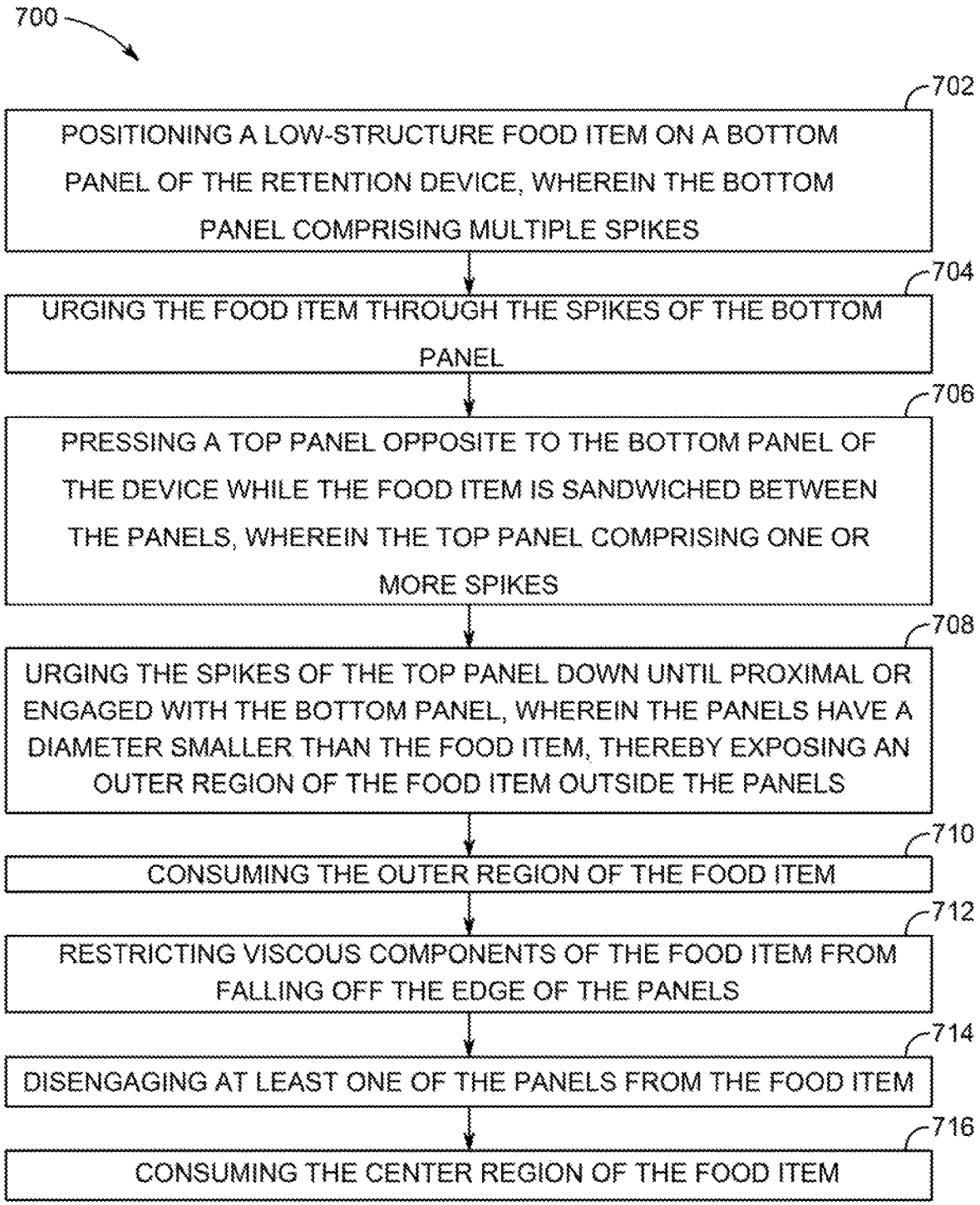
FIG. 7 illustrates a flowchart of an exemplary method for consuming a low-structure food item with a retention device, in accordance with an embodiment of the present invention.

FIG. 7 illustrates a flowchart of an exemplary method 700 for consuming a low-structure food item 300 with a retention device. The method 700 may include an initial Step 702 of positioning a low-structure food item, preferably positioning the center region of a low-structure food item on a flat and rigid bottom panel of the retention device, the bottom panel is defined by a by a rim, a food side, and an external side, multiple rigid spikes extending from the food side of the bottom panel. The method 700 may further comprise a Step 704 of urging the food item through the spikes of the bottom panel.

A Step 706 includes pressing a flat, rigid top panel opposite to the bottom panel of the device while the food item is being sandwiched between the panels, the top panel defined by a food side, and an external side, multiple rigid spikes extending from the food side of the top panel. FIG. 3 illustrates a perspective view of an exemplary low-structure food item 300 being positioned between a pair of panels 102*a*, 102*b*, with the spikes 100 penetrating the food item 300.

In some embodiments, a Step 708 comprises urging the spikes of the top panel down until proximal or engaged with the bottom panel, wherein the panels have a diameter smaller than the food item, thereby exposing an outer region of the food item outside the panels.

A Step 710 includes consuming the outer region of the food item. FIG. 4 illustrates a perspective view of an outer region 400 of the food item 300 being consumed while held between the panels 102*a*, 102*b*. The panels 102*a*, 102*b* are sized to enable consumption of a substantial amount of the food item 300 while the panels 102*a*, 102*b* are engaged.

In some embodiments, a Step 712 may include restricting viscous components of the food item from falling off the edge of the panels with the rim of the bottom panel, wherein the rim of the bottom panel is raised to a predetermined height thereby creating a border around the center region of the food item. A Step 714 comprises disengaging at least one of the panels from the food item. The method 700 may further comprise a Step 716 of consuming a center region of the food item.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A retention device for low-structure food items, the device comprising:

a flat, rigid top panel defined by a food side and an external side, wherein one or more rigid spikes are disposed in a spaced-apart relationship from the food side of the top panel; and a flat, rigid bottom panel defined by a rim, a food side and an external side, wherein a plurality of rigid spikes are disposed in a spaced-apart relationship from the food side of the bottom panel, wherein the top panel and the bottom panel have a diameter smaller than the food item, thus allowing to sandwich the low-structure food item in between the panels and facilitate to hold the low-structure food item at its center, whereby the spikes being defined by a sharp terminus penetrate the low-structure food item to provide lateral stability to the food item, further the rim of the bottom panel is raised to a predetermined height from the flat surface of the food side thereby creating a border around a center region of the food item so as to facilitate to block viscous fluid of the food item from spilling past the rim of the bottom panel.

2. The device of claim 1, wherein the panels have a round shape.

3. The device of claim 1, wherein the low-structure food item comprises a bun-less sandwich, comprising a stacked arrangement of meat, lettuce, cheese, and condiments.

4. The device of claim 1, wherein the food item is selected from the group consisting of casseroles, gels, pates, and frozen liquids.

5. The device of claim 1, wherein the spikes are manufactured from material selected from the group consisting stainless steel, metal alloys, a rigid polymer, and wood.

6. The device of claim 1, wherein the panels are manufactured from material selected from the group consisting stainless steel, metal alloys, a rigid polymer, and wood.

7. A method of holding low-structure food items by a retention device, the method comprising:

positioning center region of a low-structure food item on a flat, rigid bottom panel of the retention device, the bottom panel is defined by a rim, a food side, and an external side, multiple rigid spikes extending from the food side of the bottom panel;

urging the food item through the spikes of the bottom panel;

pressing a flat, rigid top panel opposite to the bottom panel of the device while the food item is sandwiched between the panels, the top panel defined by a food side, and an external side, one or more rigid spikes extending from the food side of the top panel;

urging the spikes of the top panel down until proximal or engaged with the bottom panel, wherein the panels have a diameter smaller than the food item, thereby exposing an outer region of the food item outside the panels;

consuming the outer region of the food item;

restricting viscous components of the food item from falling off the edge of the panels with the rim of the bottom panel, wherein the rim of the bottom panel is raised to a predetermined height thereby creating a border around the center region of the food item;

disengaging at least one of the panels from the food item; and consuming the center region of the food item.

8. The method of claim 7, wherein the panels have a round shape.

9. The method of claim 7, wherein the low-structure food item comprises a bun-less sandwich, comprising a stacked arrangement of meat, lettuce, cheese, and condiments.

10. The method of claim 7, wherein the food item is selected from the group consisting of comprises casseroles, gels, pates, and frozen liquids.

11. The method of claim 7, wherein the spikes and the panels are manufactured from material selected from the group consisting stainless steel, metal alloys, a rigid polymer, wood and a combination thereof.

12. The method of claim 7, wherein the method allows the retention device to hold the low-structure food item during preparation, holding, and consumption.

* * * * *